US005983568A

United States Patent [19]

Cianetti

[11] Patent Number: 5,983,568

[45] Date of Patent: Nov. 16, 1999

[54] OPENING SYSTEM FOR SLIDING GLASS DOORS OF COUNTERS AND DISPLAY UNITS FOR THE SALE OF FOOD PRODUCTS

[75] Inventor: Alessandro Cianetti, Gorizia, Italy

[73] Assignee: N.E.M. Nord Est Meccanica S.n.c, S. Pier D'Isonzo, Italy

[21] Appl. No.: 08/944,833

[22] Filed: Oct. 6, 1997

[30] Foreign Application Priority Data

May 15, 1997 [IT] Italy ..... TS97A0005

[51] Int. Cl.[6] ..... E05D 15/26

[52] U.S. Cl. ..... 49/125; 49/425; 49/130

[58] Field of Search ..... 49/425, 426, 427, 49/209, 211, 216, 410, 411, 412, 125, 127, 128, 129, 130, 217, 218, 219; 312/138.1, 334.27, 334.33, 334.37, 334.39, 405, 304, 193.2; 16/102, 103, 104, 105, 106

[56] References Cited

U.S. PATENT DOCUMENTS

| | | | |
|---|---|---|---|
| 3,628,588 | 12/1971 | Dixon | 49/412 |
| 3,886,685 | 6/1975 | Riphagen | 49/209 |
| 4,502,246 | 3/1985 | Minami | 49/218 |
| 4,651,469 | 3/1987 | Ngian et al. | 49/217 |
| 4,669,219 | 6/1987 | Tomida | 49/130 |
| 4,833,829 | 5/1989 | Wilson | 49/426 |
| 5,070,575 | 12/1991 | Redman et al. | 16/105 |
| 5,123,128 | 6/1992 | Hines | 49/411 |
| 5,224,297 | 7/1993 | Watkins | 49/449 |
| 5,272,838 | 12/1993 | Gibbs | 49/404 |
| 5,301,468 | 4/1994 | Kamezaki | 49/209 |
| 5,839,228 | 11/1998 | Duffy | 49/209 |

*Primary Examiner*—Daniel P. Stodola
*Assistant Examiner*—Curtis A. Cohen
*Attorney, Agent, or Firm*—Browdy and Neimark

[57] ABSTRACT

An opening system in which the glass doors (1, 2) move longitudinally along a customer's side between a load bearing upper bar (3) and a lower bar (4); one or more glass doors (1) are held by upper holding bar (22) and lower holding bar (23) which have rollers (20, 21) on their inner ends; the rollers (20, 21) slide transversely along the horizontal part of the T-shaped bars used as carriages (18, 19) which are equipped with wheels (9, 14) that slide longitudinally along slideways (6, 7, 11, 12) which have horizontal bases which extend longitudinally. Two slideways (6, 7) are positioned in the load bearing upper bar (3) and their bases are placed at the same height from ground level; the remaining slideways (11, 12) are positioned in the lower bar (4) and their bases are placed at the same height from the ground level too. The remaining glass doors (2) are fixed to further holding bars (26, 27) which are attached to wheels (10, 15) that slide in other slideways (8, 13) created inside the upper bar (3) and lower bearing bar (4). The glass doors (1) connected to the carriages (18, 19) can move over the remaining glass doors (2) but all the glass doors (1, 2) meet perfectly when closed.

6 Claims, 5 Drawing Sheets

OPENING SYSTEM FOR SLIDING GLASS DOORS OF COUNTERS AND DISPLAY UNITS FOR THE SALE OF FOOD PRODUCTS

BACKGROUND OF THE INVENTION

1. Field of the Invention

The system in question can be validly employed in the field of refrigerated and non-refrigerated counters used for the retail sale of food products such as meats, cheeses, pastries, etc.

2. Description of the Prior Art

The glass doors, both single and glass panel, of counters and display units for the sale of food products are variously attached to frames sustained by posts in order to insulate the food products contained from the external environment, protecting them against dust and/or insects.

Whereas the glass doors placed on the vendor side are small and easy to handle, the doors on the customer side are often very large and consequently heavy. The special shape some of the latter take on for aesthetic reasons further increase their dimensions and weight.

Unfortunately, the glass doors placed on the customer side need to be moved at least twice a day in order to clean the inside of the counter or unit and to insert or remove the foods contained.

A number of known systems can be used to move said glass doors. The simplest consists of removing the glass from its frame and placing it on the floor until the completion of the above mentioned daily operations. However, given the weight of the glass, this procedure is rather tiring and, furthermore, each time a serious risk of the glass sliding and breaking is run.

Other solutions entail the hinging of the top or bottom edge of each glass plate to facilitate movement ensuring that at least one side remains firmly attached to the frame, entailing less physical effort. Yet, even this solution is unable to solve all the problems operators have to face. If the glass is opened downwards, large glass plates must be sustained manually during the cleaning operations and insertion/removal of food products to prevent the hinges from breaking. Therefore, the problems are multiplied: on the one hand the operator has to make the effort of propping up the glass, on the other there is the problem of not being able to move along the counter or display unit as most of it is taken up by the open glass plate.

The opening of large glass doors towards the top is rather dangerous as the edges of the doors are at the same height as that of the head of the operator and the likely consequences are quite obvious. Further, the operator is forced to work by bending over and therefore in an uncomfortable position.

To reduce the physical strain on operators, glass doors can be servo controlled for shifting. Special gas pistons or springs lodged in the casing of the frame accompany the movement of the glass doors generally in upward direction.

Though this is a useful and valid technique, the danger of accidents to the operator's head still persists and the person is forced to work in a bent position. Another problem is the cost of this device. The use of pistons and/or springs for the lifting of the glass greatly increases the production cost of counters and display units and requires periodic maintenance, the cost of which is to be borne by the management.

Sliding glass doors are widely employed in this sector. The glass plates move longitudinally and therefore there is no strain on operators and they are not endangered in any way. Unfortunately, each glass plate used runs along its own slideway with the result that the edges of the different plates are superimposed and therefore never meet, and the dreaded insects or dust can gather in the gap between the plates.

SUMMARY OF THE INVENTION

The object of the invention in question is to provide users with a system that is able to guarantee longitudinal movement of glass doors of counters and display units and able to make the sides of the various glass plates meet.

A further object is to reduce costs and the time required for the production and maintenance operations of said structures.

Said object and others are attainable by the opening system in question in the patent hereof, which entails the longitudinal sliding of the glass plates on the customer side.

Any number of glass plates both single and glass panel move along two bars of any length (an upper and a lower bar): the upper bar alone bears the load; it is sustained by posts placed at its ends or in any other position.

Both bars are molded to form three longitudinal slideways, two of which have a horizontal base placed at the same height to form a track. The third slideway, which also has a horizontal base, is placed at a lower level in the upper bar and at a higher level in the lower bar.

Two branches of the upper bar lie between the slideways of equal height of the upper bar, forming another longitudinal slideway which is shaped in such a way as to allow for the sliding of a limiting component within it, yet preventing said limiting component from running off the slideway. The two items have a tongue and groove type fitting.

Said limiting component forms the tip of the arm of a third T-shaped bar which is used as a carriage and is equipped with wheels or rollers which slide longitudinally in the above mentioned slideways placed at the same height. The carriage can be as long as or shorter than the glass door.

The longer, horizontal part—both of the shifting carriage on the upper bar and the sliding carriage on the lower bar—is of the same shape: two depressions separated by a relief. Rollers or wheels that are fixed to two further bars (an upper and a lower bar) which hold the same glass plate are placed on the upper surface of said carriages.

By means of glass runs (which narrow down towards the external tips), other bars block the remaining glass doors. Wheels or rollers attached to said bars are free to slide longitudinally in the slideways of the bars placed at a lower or higher level with respect to those that form the above mentioned tracks.

The load bearing bar has housings for a lamp socket, the protection of the lamp (using special material) and the insert that acts as the upper and rear cover. The insert, in turn, has slots to lodge sliding plexiglas panels on the vendor side.

One or more glass doors are attached to two or more sliding carriages in the four slideways (two upper and two lower) placed in track form, whereas the other glass panel/panels move along the two remaining single slideways (one upper and one lower) placed at a higher or lower level.

Consequently, all the glass doors can be moved and meet perfectly when closed. When the glass doors have to be moved, the one (or ones) on the carriages are snapped towards the customer side of the counter or display unit. The door (or doors) which are not coupled with carriages can therefore move longitudinally under the plates that are attached to the carriages as the latter do not obstacle their movement.

The special shape of the carriages assures that the glass doors mounted on carriages can be opened only if a certain amount of pressure is applied, thus preventing accidental or incorrect movements on the part of the operator or the customers.

The limiting component fitted in the slideway ensures that upper carriage and connected glass door do not fall off the slideway, preventing the glass from toppling over onto the customer side if the door is pulled too forcefully.

After moving said upper carriage and the glass connected to it, these need not occupy their original position and can take the place formerly occupied by another glass plate.

BRIEF DESCRIPTION OF THE DRAWINGS

Further characteristics and advantages of the invention will appear more clearly from the description of a preferred—but not necessarily sole—embodiment of the sliding glass door system in question, which is illustrated for indicative and not restrictive purposes in the following drawings in which.

DETAILED DESCRIPTION OF THE PREFERRED EMBODIMENT

Figure 1:
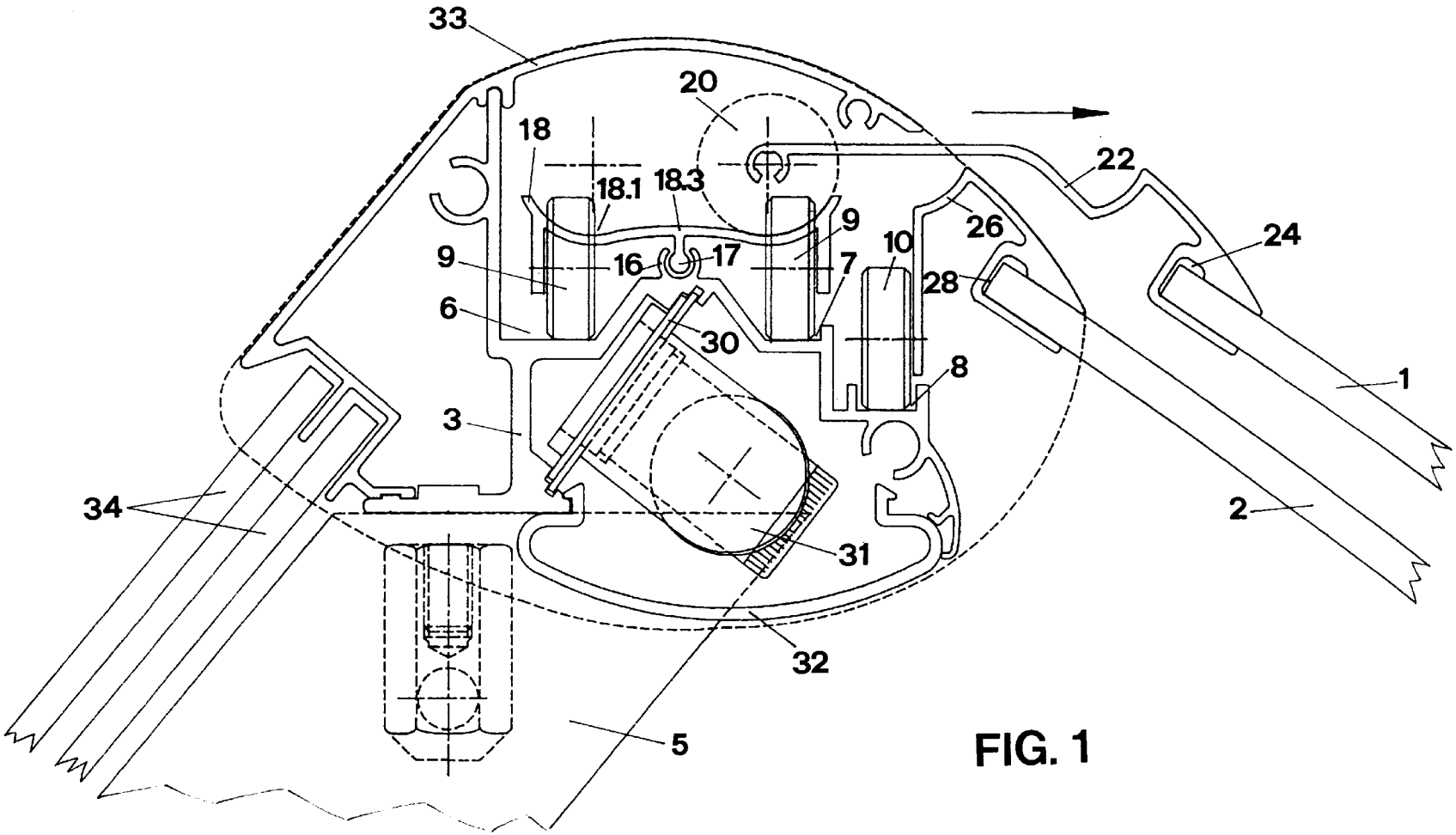
FIGS. 1 and 2 respectively show the cross-section of the upper and lower part of the structure of a counter or display unit (and glass doors) during the stage in which a glass door fixed to a carriage is lifted.
Figure 2:
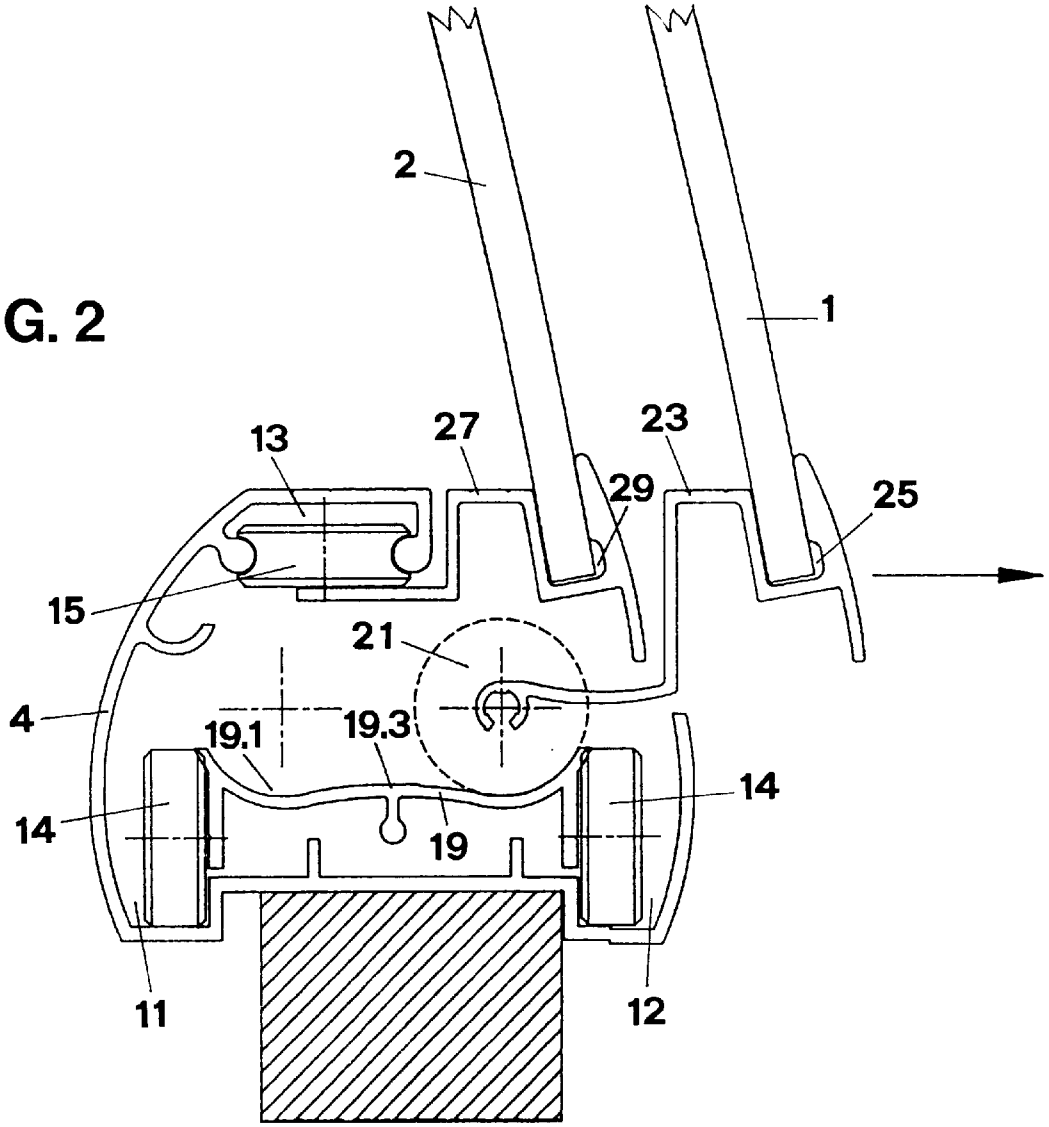
Figure 3:
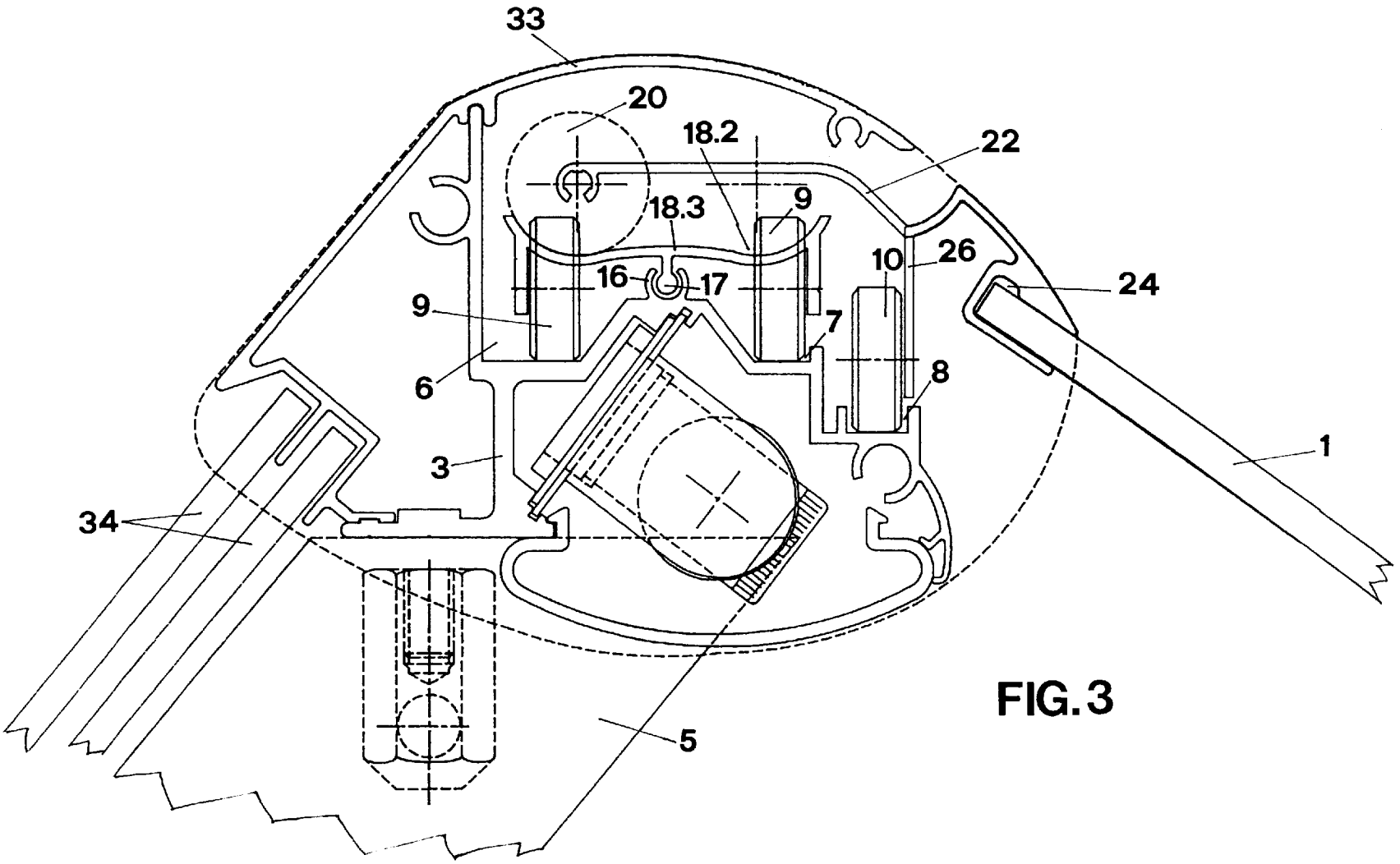
FIGS. 3 and 4 illustrate the cross-section of the same parts of the structure of a counter or display unit (and glass doors) during the stage in which the glass fixed to a carriage is at rest.
Figure 4:
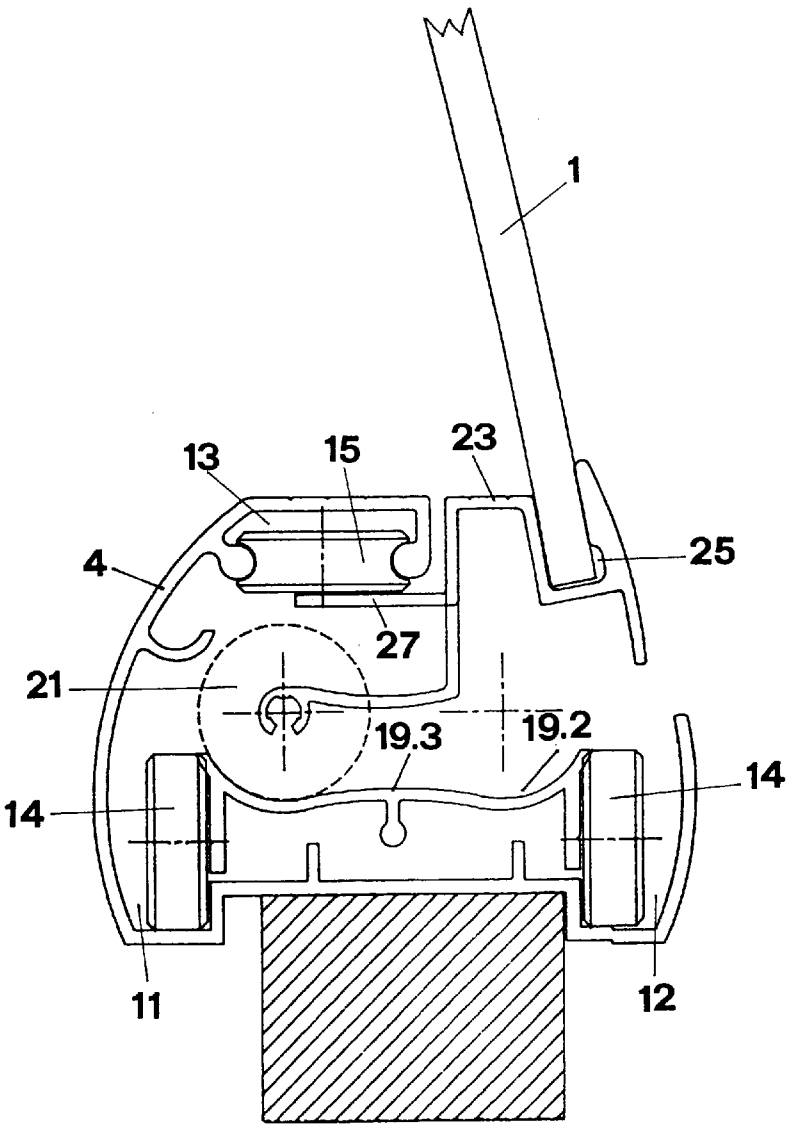
Figure 5:
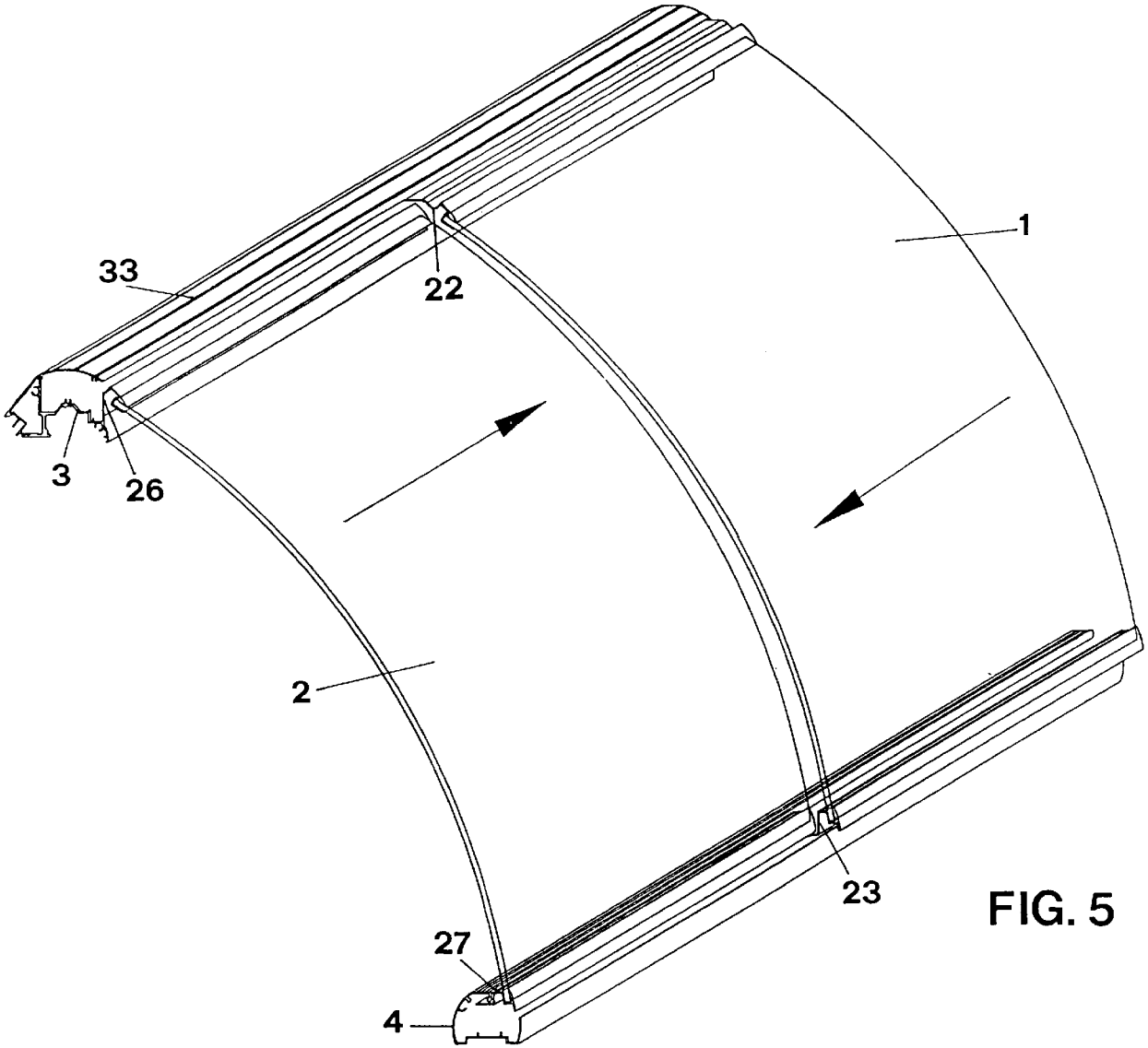
FIG. 5 is a perspective view of the two glass doors and relative bars during movement.

In greater detail, the system for counters and display units in question envisages the use of: two glass plates 1 and 2 placed on the customer side, a load bearing upper bar 3 and a lower bar 4. The upper bar 3 is sustained by posts 5 at either end. The upper bar 3 has three longitudinal slideways 6, 7 and 8 which have a horizontal base, two of which are placed at the same height. Wheels 9 run longitudinally along slideways 6 and 7, which are at the same height. Wheels 10 run along the third slideway 8, whose base is placed at a lower level with respect to the bases of slideways 6 and 7. Similarly, the lower bar 4 has three slideways 11, 12 and 13; the bases of slideways 11 and 12 are placed at the same level whereas the third slideway 13 is at a higher level. Wheels 14 run along slideways 11 and 12 whose bases are at the same height; wheels 15 are placed in the remaining slideway 13. Between slideways 6 and 7, which are of the same height, lie two branches of the upper bar 3. They form a longitudinal U-shaped slideway 16, in which a cylindrical rod 17, which forms the lower tip of a vertical arm of a third bar, is lodged. Said bar is T-shaped and is used as a carriage 18. In fact, wheels 9 are fixed to it and, as a consequence, carriage 18 is free to move longitudinally along the entire length of bar 3.

A similar bar is used to form carriage 19 on the lower bar 4. Carriage 19 has wheels 14 which run longitudinally along slideways 11 and 12, whose bases are placed at the same height.

Both carriages 18 and 19 have the same shape: their horizontal portions each have two depressions, 18.1, 18.2, 19.1, 19.2 separated byarelief 18.3, 19.3.

Rollers 20 and 21 run transversally across depressions 18.1, 18.2, 19.1, 19.2. Said rollers 20 and 21 are fixed to the inner ends of two further bars 22, 23, which have glass runs on their outer ends 24, 25 in which glass door 1 is inserted and locked.

Two other bars 26, 27 hold a second glass door 2 by means of runs 28, 29 placed at their ends. Wheels 10 and 15 are constrained to the other ends of bars 26 and 27 and are free to run within slideways 8 and 13.

Bar 3 has housings for the socket 30 of a lamp 31, the protective methacrylate casing 32 of lamp 31, and insert 33 which acts as a cover. Insert 33, in turn, has slots for rear plexiglas sliding plates 34.

Glass door 2 is free to slide along bars 3 and 4 thanks to wheels 10 and 15 lodged in slideways 8 and 13. When glass plates 1 and 2 are placed side by side they match perfectly, and glass bearing bars 22 and 23 adhere to bars 3 and 4; rollers 20 and 21 of bars 22 and 23 are placed in depressions 18.1 and 19.1 which lie on the inside of carriages 18 and 19.

If glass plates 1 and 2 are to be moved, the glass bearing bar 22 must be gripped (it has a special indented portion) and pulled towards the customer side. After overcoming reliefs 18.3 and 19.3, rollers 20 and 21 are forced to house in depressions 18.2 and 19.2 which lie outside carriages 18 and 19. Bars 22 and 23, which hold glass door 1, detach themselves from bars 3 and 4. At this point it is possible to move carriages 18 and 19 along the entire length of bars 3 and 4 in their slideways 6, 7, 11, 12, moving glass door 1 over glass door 2. The shifting of glass door 1 from its initial position allows for access to the corresponding internal part of the counter or display unit to carry out routine daily operations. Then, the two glass doors 1 and 2 are coupled and superimposed and moved to the area initially occupied by glass door 1, freeing the second half of the counter or display unit. Once this half of the cleaning operation and/or insertion/removal of food products has also been completed, glass door 1 or 2 is moved until it occupies the free portion of the counter or display unit.

To reposition glass door 1, the glass bearing bar 22 must be gripped from the top and pushed towards the vendor side. Once rollers 20 and 21 have overcome reliefs 18.3 and 19.3, they are forced to once again lodge in depressions 18.1 and 19.1 inside carriages 18 and 19. Bars 22 and 23, which hold glass door 1, once again meet up with bars 3 and 4, preventing any further movement of glass doors 1 and 2 and making them tally perfectly once more.

Carriages 18 and 19 (and consequently glass door 1) do not necessarily have to be placed in the original position of door 1; they may take the place of door 2.

Carriage 18 cannot fall out of its slideways 6 and 7 because of a cylindrical rod 17 that is held by U-shaped slideway 16. Apart from guiding carriage 18, cylindrical rod 17 and slideway 16 prevent the carriage from toppling over onto the operator in case of excessive force while pulling glass door 1 towards the customer side.

The special shape of reliefs 18.3 and 19.3 provides a certain amount of resistance during the opening stage of carriages 18 and 19 to facilitate the repositioning of glass door 1 in its closed position in case of accidental or incorrect opening.

Once reliefs 18.3 and 19.3 have been overcome, carriages 18 and 19 place themselves correctly in their respective external depressions 18.2, 19.2 in the same manner each time the glass doors are opened.

Thus conceived, the system may be subjected to a number of modifications and variations, which all, however, fall under the sphere of the original invention. Furthermore, all details may be replaced by technically equivalent solutions.

I claim:

1. An opening system for display units for sale of food products, said opening system having a plurality of sliding doors, at least one of which is moveable longitudinally along and between a load bearing upper bar (3) and a lower bar (4);

the upper bar (3) being sustained by posts (5);

said upper bar (3) having four horizontal slideways (6, 7, 8, 16);

a base of a first and second of said four horizontal slideways of said upper bar being placed at a first height from ground level;

said lower bar (4) having three horizontal slideways (11, 12, 13);

a base of a first and second of said three horizontal slideways of said lower bar being placed at a second height from ground level;

a base of a third of said four slideways of the upper bar (3) being placed at a lower from ground level with respect to that of the first and second slideways (6, 7) of the upper bar (3);

a base of a third of said three slideways of the lower bar (4) being placed at a higher from ground level with respect to that of the first and second slideways (11, 12) of the lower bar (4);

a projection between the first and second slideways of the upper bar (3) having a fourth slideway (16) of the four horizontal slideway of the upper bar (3);

an upper carriage bar (18) having wheels (9) that respectively slide longitudinally in the first and second slideways of the upper bar (3) and a projection (17) slidably engaged in the fourth slideway of said upper bar;

a lower carriage bar (19) having wheels (14) that respectively slide longitudinally in the first and second slideways (11, 12) of the lower bar (4);

a top side of the upper carriage bar (18) having a first and second longitudinal depression (18.1, 18.3) separated by a first relief (18.3);

a top side of the lower carriage bar (19) having a third and fourth longitudinal depression (19.1, 19.2) separated by a second relief (18.3);

a first upper holding bar (22) having upper rollers (20) rotatably engaged to a first end thereof, said rollers (20) engaged in a first selected one of said first and second depressions of said upper carriage and moveable transverse over said first relief from said first selected depression;

a first lower holding bar (23) having lower rollers (21) rotatably engaged to a first end thereof, said rollers (21) engaged in a second selected one said third and fourth depressions of said lower carriage (19) and moveable transverse over said second relief from said second selected depression;

a second end of said first upper holding bar (22) and said first lower holding bar (23) respectively fixed to a first door of said plurality of doors;

a second upper holding bar (26) having rollers (10) rotatably engaged to a first end thereof and a second end thereof fixed to second door of said plurality of doors;

a second lower holding bar (27) having rollers (15) rotatably engaged to a first end thereof and a second end thereof fixed to said second door of said plurality of doors;

said wheels (10) of said second upper holding bar (26) slidably engaged in said third of said four slideways of said upper bar;

said wheels (15) of said second lower holding bar (27) slidably engaged in said third of said three horizontal slideways of said lower bar, and wherein said first door can be moved transverse to a plane of said second door to facilitate maintenance of said unit.

2. The opening system according to claim 1, wherein, the upper bar (3) houses a socket (30) for a lamp (31), a protective cover (32) on a lower side of the upper bar (3) for protecting the lamp (31) and an insert cover on an upper side of the upper bar having slots for sliding plates on a vendor side of said unit.

3. The opening system according to claim 1, wherein the upper carriage bar and the lower carriage both are T-shaped.

4. The opening system according to claim 1, wherein all of the plurality of doors are moveable and engage in the same plane when closed.

5. The opening system according to claim 1, wherein each of the plurality of doors, with exception of the first door, are slidably engagable with said unit in the same manner as the second door.

6. The opening system according to claim 1, wherein the plurality of doors are made of glass.

* * * * *